US006058845A

United States Patent [19]

Kelm

[11] Patent Number: 6,058,845

[45] Date of Patent: May 9, 2000

[54] ADJUSTABLE BELT TRANSMISSION DEVICE FOR A PRINTING MACHINE

[75] Inventor: Carsten Kelm, Mannheim, Germany

[73] Assignee: Heidelberger Druckmaschinen Aktiengesellschaft, Munich

[21] Appl. No.: 09/048,559

[22] Filed: Mar. 26, 1998

[30] Foreign Application Priority Data

Mar. 26, 1997 [DE] Germany ..... 197 12 690

[51] Int. Cl.[7] ..... F16H 7/10

[52] U.S. Cl. ..... 101/494; 101/DIG. 48; 474/112

[58] Field of Search ..... 101/494, DIG. 48; 474/112

[56] References Cited

U.S. PATENT DOCUMENTS 3,737,115 6/1973 Baker ..... 242/420.3
5,078,656 1/1992 Brandenstein et al. ..... 474/112
5,291,252 3/1994 Kawaishi ..... 399/308
5,328,415 7/1994 Furutani ..... 474/112

*Primary Examiner*—John Hilten
*Assistant Examiner*—Daniel J. Colilla
*Attorney, Agent, or Firm*—Herbert L. Lerner; Laurence A. Greenberg; Werner H. Stemer

[57] ABSTRACT

A transmission device for a printing machine having an endless transmission element, and rotating bodies around which the transmission element is wrapped, includes a tensioning device for tautening the transmission element, and an actuating device for displacing a first one of the rotating bodies parallel to the axis of rotation thereof, the tensioning device being formed by the actuating device, the actuating device having a tensioning shaft operatively connected to the first rotating body, the tensioning shaft, when rotated about a longitudinal axis thereof, causing a lateral displacement of a center-of-mass line thereof.

7 Claims, 6 Drawing Sheets

ADJUSTABLE BELT TRANSMISSION DEVICE FOR A PRINTING MACHINE

BACKGROUND OF THE INVENTION

Field of the Invention

The invention relates to a transmission device for a printing machine, more particularly, having an endless transmission element, rotating bodies around which the transmission element is wrapped, a tensioning device for tautening the transmission element, and an actuating device for displacing a first one of the rotating bodies parallel to the axis of rotation thereof.

A transmission device of this general type is disclosed, for example, in the published German Patent Document DE 44 23 286 A1. It is used to drive a supplemental roller of a printing unit in which, in a first operating state, there is contact between a printing plate carried by a plate cylinder and the additional roller and, in a second operating state, there is contact between an inking-unit roller and the supplemental roller. The supplemental roller is carried by an actuating device by which it is possible to change the operating states while performing a displacement of the supplemental roller parallel to the axis of rotation of the supplemental roller. The tensioning device which is provided for tautening the transmission element acts upon the slack side of the transmission element and has a tensioning roller which is prestressed under spring force in the direction of the slack side and rolls on the latter.

In the case of the foregoing heretofore known transmission device, the transmission element is always tautened, and indeed, independently of which of the operating states the printing unit is in, that is to say, irrespective of what position the axis of rotation of the supplemental roller is in.

Transmission devices intended for other purposes are disclosed, for example, in the published European Patent Document WO 95/01930. These transmission devices, respectively, are formed of a pair of deflector rollers which are positioned with mutual axial spacing. A respective pair of the deflector rollers has wrapped around itself a transmission element in the form of a revolving suction belt, which sweeps over a suction box and is thus used for the temporary guidance of a sheet that is placed on the transmission element and has been output from a printing unit of a printing machine. In this case, the circumferential speed of the transmission element depends upon the application of the respective transmission device; in one case this application is the pure transport of a sheet at machine speed and in another case the retardation of a sheet to a delivery speed. In the latter case, in particular, the transmission elements are subjected to a given amount of wear, so that these transmission elements have to be renewed at specific time intervals.

It is generally the case that, in the transmission devices cited, there are no increased demands on dimensional stability in relation to the length of the transmission elements. Slight deviations in this length are taken into account by providing a tensioning device with which tautening of the transmission element can be effected.

An appropriate tensioning device is not provided for the transmission devices disclosed in the aforementioned published European Patent Document WO 95/01930. In order to install suitably a tensioning device appropriate for the transmission device mentioned at the introduction hereto, a given amount of available installation space is necessary both between the sides or strands of the transmission element and outside the latter. In the case of the transmission devices according to the published European Patent Document WO 95/01930, there are relatively restricted spatial conditions both between the strands or sides and outside or beyond them, the spatial conditions being caused specifically, on the one hand, by a suction box arranged within the runs and, on the other hand, by the close proximity of at least one of the transmission devices to further constructional elements, such as floating guides in this case.

SUMMARY OF THE INVENTION

It is accordingly an object of the invention to provide a transmission device for a printing machine which is configured in such a manner that it takes up the smallest possible constructional space.

With the foregoing and other objects in view, there is provided, in accordance with the invention, a transmission device for a printing machine having an endless transmission element, and rotating bodies around which the transmission element is wrapped, comprising a tensioning device for tautening the transmission element, and an actuating device for displacing a first one of the rotating bodies parallel to the axis of rotation thereof, the tensioning device being formed by the actuating device, the actuating device having a tensioning shaft operatively connected to the first rotating body, the tensioning shaft, when rotated about a longitudinal axis thereof, causing a lateral displacement of a center-of-mass line thereof.

In accordance with another feature of the invention, the longitudinal axis and the center-of-mass line of the tensioning shaft are mutually spaced apart from one another, the first rotating body is supported by a laterally displaceable axle, and the operative connection between the tensioning shaft and the first rotating body is located in a respective end section of the axle.

In accordance with a further feature of the invention, the longitudinal axis and center-of-mass line of tensioning shaft are mutually spaced apart, the first rotating body is rotatably mounted in a frame which is displaceable for changing the axial spacing of the rotating bodies, and the operative connection between the tensioning shaft and the first rotating body is formed via the frame.

In accordance with an added feature of the invention, the said longitudinal axis and the center-of-mass line of the tensioning shaft are mutually spaced apart, and the tensioning shaft has at least one running ring mounted eccentrically to the longitudinal axis of the shaft.

In accordance with an additional feature of the invention, the longitudinal axis and the center-of-mass line of the tensioning shaft are mutually spaced apart, and the tensioning shaft has at least one section eccentric to the longitudinal axis of the tensioning shaft and rotatably supports the first rotating body.

In accordance with yet another feature of the invention, the longitudinal axis and the center-of-mass line of the tensioning shaft are mutually spaced apart, and the tensioning shaft is mounted so that it is laterally displaceable, has a shaft section rotatably supporting the first rotating body and has at least one crankpin eccentric to the shaft section and is articulatedly connected to a crank pivotable about a pivot axis fixed with respect to a second one of the rotating bodies.

In accordance with yet a further feature of the invention, the longitudinal axis and the center-of-mass line of the tensioning shaft are mutually spaced apart, the tensioning shaft is mounted so that it is displaceable laterally, has a shaft section rotatably supporting the first rotating body and has at least one crankpin eccentric to the shaft section, and a rectilinear guide supporting the crankpin is included.

In accordance with yet an added feature of the invention, the tensioning shaft is mounted so that it is displaceable laterally, has a shaft section rotatably supporting the first rotating body and is connected to at least one gear wheel so as to be fixed against rotation relative thereto, and at least one rack whereon the at least one gear wheel is rollable when the tensioning shaft is rotated is included.

In accordance with yet an additional feature of the invention, the transmission device includes a force storing device for acting upon the tensioning shaft, and for applying a torque to the tensioning shaft.

In accordance with another feature of the invention, the tensioning shaft is fixable in a position assumable while the center-of-mass line of the shaft is displaced.

In accordance with a further feature of the invention, the transmission device includes a screw connection for providing an increased braking torque counter to a screwing operation, so as to fix the tensioning shaft.

In accordance with a concomitant feature of the invention, the transmission device is in a sheet transport device cooperating with a printing unit of a sheet-fed printing machine.

Other features which are considered as characteristic for the invention are set forth in the appended claims.

Although the invention is illustrated and described herein as embodied in a transmission device for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
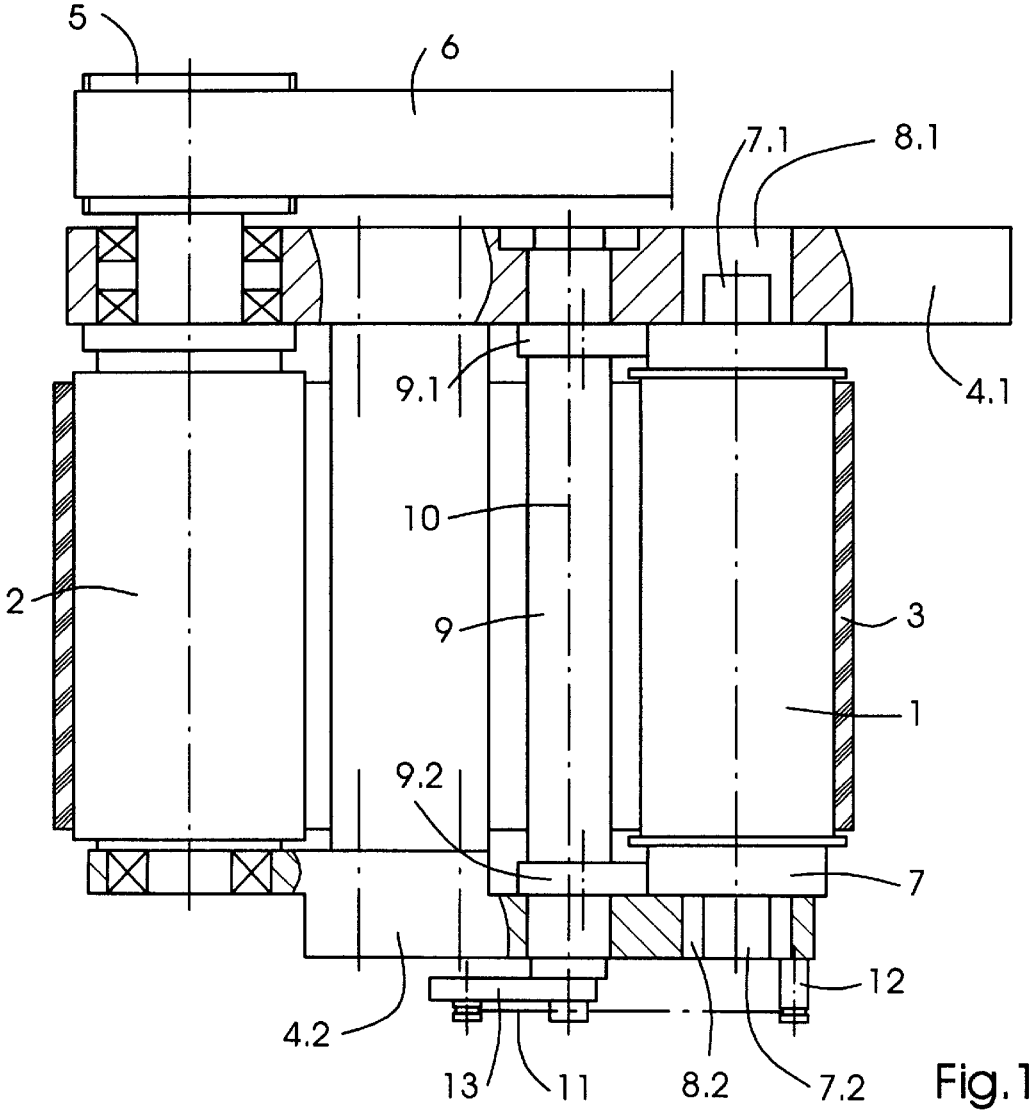
FIG. 1 is a top plan view, partly broken away and partly in section, of an embodiment of a transmission device according to the invention, having a tensioning shaft with a center-of-mass line thereof spaced a distance from the longitudinal axis thereof.

Referring now to the drawings and, first, particularly to FIG. 1 thereof, there is shown therein a transmission device constructed in accordance with the invention, including a first rotating body 1 and at least one second rotating body 2, both having an endless transmission element 3 wrapped around them. In the exemplary embodiment of FIG. 1, the second rotating body 2 is a diverting roller which drives the transmission element 3 and is rotatably mounted in bearing plates 4.1 and 4.2 which are disposed opposite one another. The diverting roller 2 is connected to a belt pulley 5 so as to be fixed against rotation relative thereto, the belt pulley 5, for its part, having a drive belt 6 wrapped around it and revolving when in operation. The first rotating body 1, which is driven by the transmission element 3, is formed, in the embodiment of FIG. 1, of a diverting sleeve which is rotatably mounted on an axle 7 which is displaceable laterally so that a lateral displacement thereof takes place while the mutual axial spacing of the two rotating bodies 1 and 2 is changed. To this end, each axle journal 7.1 and 7.2 of the axle 7 is guided in a slot 8.1 or 8.2, which is matched to the diameter of the respective axle journal 7.1 or 7.2, in a respective bearing plate 4.1 and 4.2. In order to change the mutual axial spacing of the two rotating bodies 1 and 2, provision is made for an actuating device which has a tensioning shaft 9 that is operatively connected to the first rotating body 1. A respective end section of the tensioning shaft 9 is mounted in a respective bearing plate 4.1 or 4.2 so that it can rotate with respect to the longitudinal axis 10 of the tensioning shaft. In the case of the configuration according to FIG. 1, the operative connection between the tensioning shaft 9 and the first rotating body 1 is provided in a respective end section of the axle 7. The tensioning shaft 9 has a center-of-mass line which is spaced from the longitudinal axis 10 thereof. In the case at hand, this results from the construction or design of two shaft sections 9.1 and 9.2, which are eccentric to the longitudinal axis 10, on the tensioning shaft 9. The eccentric shaft sections 9.1 and 9.2, respectively, have a cylindrical outer surface and are assigned to the respective one of the end sections of the axle 7 in such a manner that the outer surface of the respective one of the end sections of the axle 7 can be brought into contact with that respective one of the eccentric shaft sections 9.1 and 9.2. With such an operative connection between the tensioning shaft 9 and the first rotating body 1, and with identical geometric relationships as viewed on the respective eccentric shaft section 9.1 and 9.2 and the respective end section of the axle 7 being provided, the first rotating body 1 experiences a displacement parallel to the axis of rotation when the tensioning shaft 9 is rotated. In addition, this displacement takes place as a result of the abovementioned mounting of the axle journals 7.1 and 7.2 in the slots 8.1 and 8.2, while the mutual axial spacing of the two rotating bodies 1 and 2 is changed. The actuating device formed by the aforementioned tensioning shaft 9 thus also constitutes a tensioning device by which, due to the rotation of the tensioning shaft 9 in a specific direction, tautening of the transmission element 3 can be effected, because the center-of-mass line of the tensioning shaft 9 is displaced laterally when the latter is rotated. The operative connection of the type between the tensioning shaft 9 and the first rotating body 1 provided in a respective end section of the axle 7, also offers the advantage that the transmission element 3 can be tautened uniformly over the width thereof.

In order to achieve the tautened state of the transmission element 3 as a result of the displacement of the center-of-mass line of the tensioning shaft 9, and in order to maintain this state, provision is made for a force or power storing device 11 which acts upon the tensioning shaft 9 and, by which a torque can be applied to the tensioning shaft 9. This achieves the automatic re-tensioning of the transmission element 3.

Figure 2:
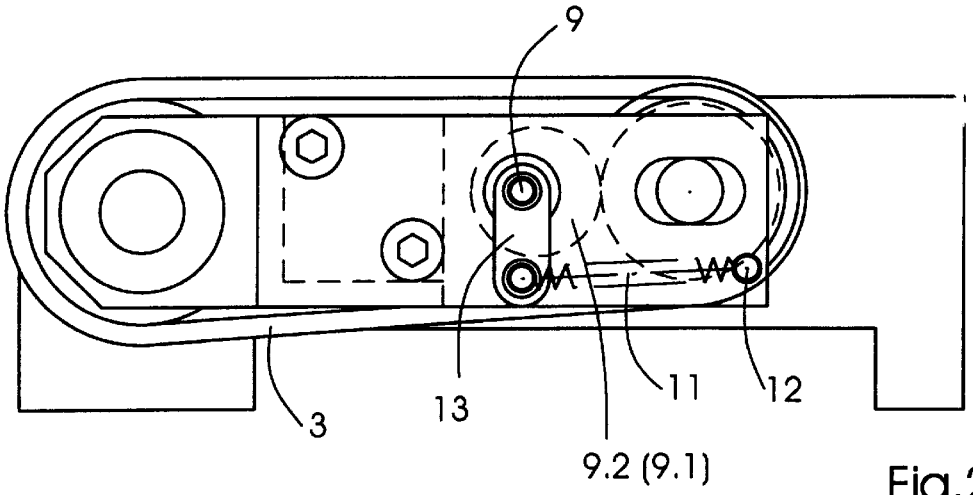
FIG. 2 is a side elevational view of FIG. 1 as seen from the bottom of the latter figure.

In the configuration according to FIG. 1 and FIG. 2, the force storing device 11 is a helical spring which is stressed in tension and which, at one end, is hooked onto a pin 12 which is fastened in the bearing plate 4.2 and, at the other end, is hooked onto a lever 13 which is connected to the tensioning shaft 9 so as to be fixed against rotation relative thereto.

The transmission element 3 can therefore be relieved of tension by simply unhooking the helical spring and, thus, in the event it becomes unusable as a result of wear, it can be exchanged in a straightforward manner. To this end, the bearing plate 4.2 is also dimensioned so that the transmission element 3 can be pulled off over the bearing plate, away from the rotating bodies 1 and 2.

Figure 3:
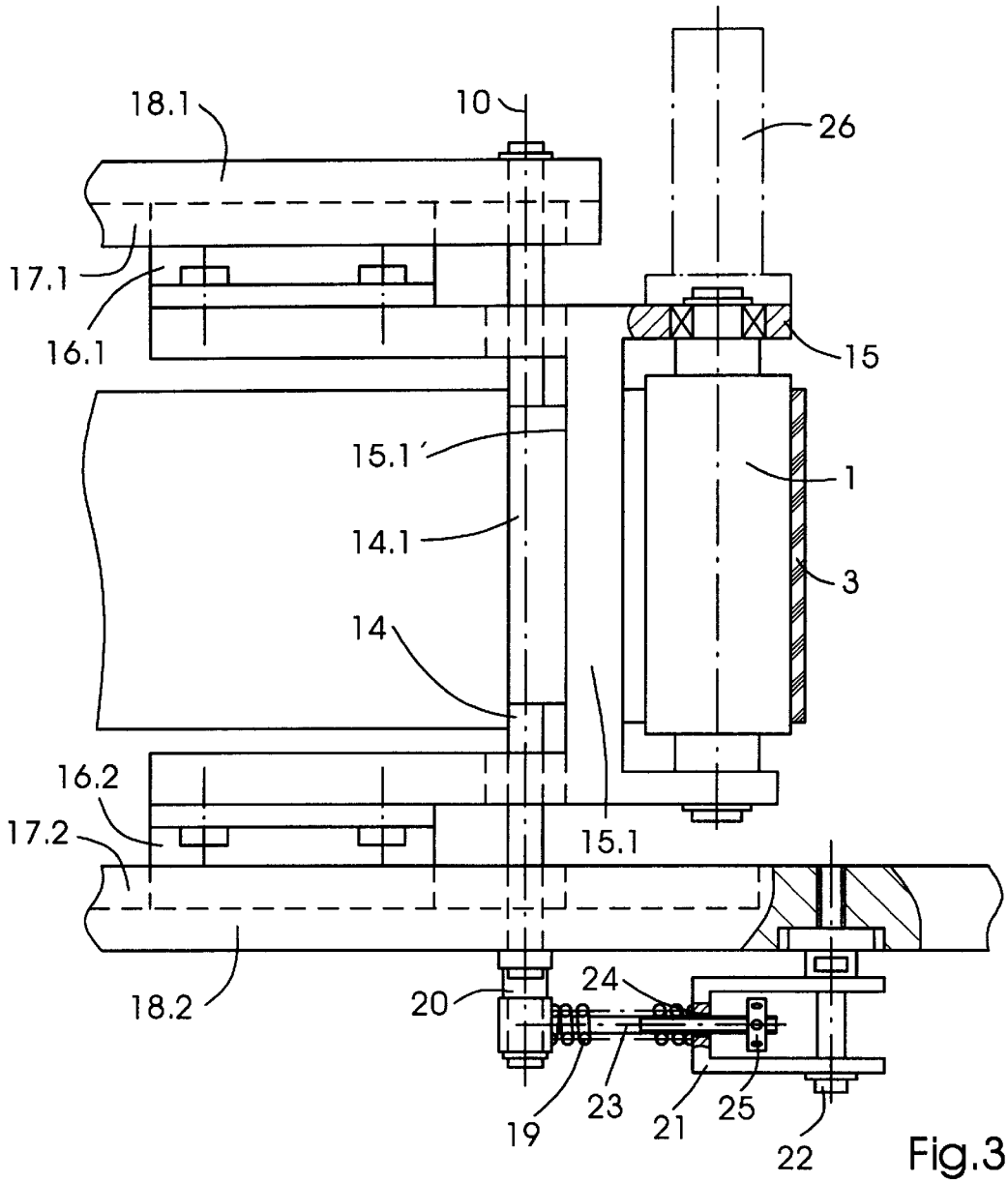
FIG. 3 is a top plan view, partly broken away and partly in section, of another embodiment of the transmission device according to the invention, which is modified with respect to the mounting of the first rotating body that is operatively connected to the tensioning shaft.

In the configuration of the transmission device shown in FIG. 3, the tensioning shaft 14 likewise has a center-of-mass line which is spaced from the longitudinal axis 10 thereof. This results, in this regard, from the construction or design of a shaft section 14.1 of the tensioning shaft 14 which is mounted in the respective one of two mutually opposite bearing plates 8.1 and 8.2 so that it is rotatable with respect to the longitudinal axis 10, the shaft section 14.1 being eccentric to the longitudinal axis 10. The first rotating body 1 is rotatably mounted in a frame 15 which is displaceable so as to effect a change in the axial spacing between the first rotating body 1 and the second rotating body 2 which is not illustrated in FIG. 3. To this end, in the exemplary embodiment of FIG. 3, the frame 15 is provided with runners 16.1 and 16.2 which are guided in a respective longitudinal groove 17.1 and 17.2 of the respective one of the bearing plates 18.1 and 18.2. The second rotating body 2 not shown in FIG. 3 is rotatably mounted in the respective one of the bearing plates 18.1 and 18.2. The frame 15 has a transverse web 15.1 which, at a supporting surface 15.1' of the transverse web 15.1 which faces the second rotating body 2, can be brought into contact with the outer surface of the eccentric shaft section 14.1 of the tensioning shaft 14.

FIG. 3 illustrates a state in which this contact exists. This state is achieved and maintained by a force storing device 19 which acts upon the tensioning shaft 14 and by which a torque can be applied to the tensioning shaft 14. An operative connection between the tensioning shaft 14 and the first rotating body 1 is thus produced via the frame 15.

In the exemplary embodiment of FIG. 3, the force storing device 19 is a helical spring which is stressed in compression. The spring 19 is supported, as is also revealed, in particular, in FIG. 4, at one end by a lever 20 which is connected to the tensioning shaft 14 so as to be fixed against rotation relative thereto and, at the other end, by a fork 21 which can be pivoted about a journal 22 which is parallel to the tensioning shaft 14 and fastened in the bearing plate 18.2.

Overall, an actuating device is once more provided by which the first rotating body 1 can be displaced parallel to the axis of rotation thereof, and this actuating device constitutes a tensioning device by which tautening of the transmission element 3 can be effected by rotating the tensioning shaft 14 about the longitudinal axis 10 thereof, with the simultaneously occurring lateral displacement of the center-of-mass line of the tensioning shaft 14.

Just as in the case of the configuration according to FIG. 1 and FIG. 2, with an existing operative connection between the tensioning shaft 14 and 9, respectively, and the first rotating body 1 being provided, the rotational position of an appropriate eccentric shaft section 14.1 and 9.1, 9.2, respectively, is selected so that a rotation of the tensioning shaft 14 and 9, respectively, occurring under the action of the force storing device 11 or 19, respectively, effects a displacement of the first rotating body 1 with the effect of increasing the mutual axial spacing of the two rotating bodies 1 and 2.

Figure 4:
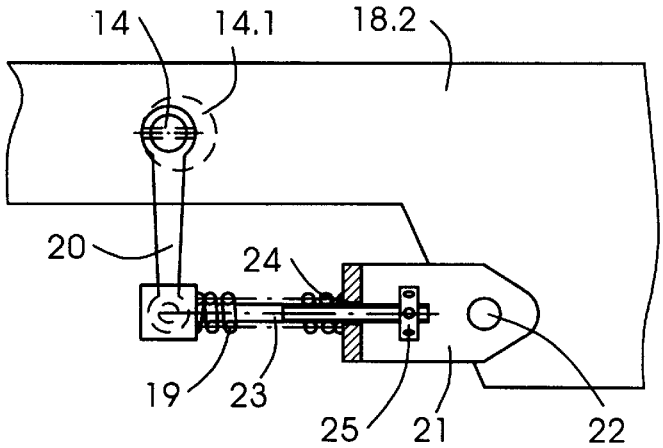
FIG. 4 is an enlarged fragmentary side elevational view of FIG. 3.

In the configuration according to FIG. 3 and FIG. 4, the abovementioned action of the force storing device 19 formed as a helical spring which is stressed in compression can be canceled in a particularly straightforward manner, and the transmission element can be exchanged. To this end, as is revealed, in particular, in FIG. 4, the lever 20 is articulatedly connected to a guide shaft 23, which passes through a through-bore 24 formed in a base part of the fork 21 and is provided with a thread. Through the intermediary of a setting or lock nut 25 which is screwed onto this thread, the helical spring constituting the force storing device 19, which is pushed onto the guide shaft 23 and is stressed in compression, can be shortened. When the helical spring is shortened appropriately, the tensioning shaft 14 then assumes a rotational position in which the frame 15, and hence the first rotating body 1, are freely displaceable with the effect of reducing the mutual axial spacing of the two rotating bodies 1 and 2. In a correspondingly displaced position of the first rotating body 1, it is then possible for the transmission element 3 to be drawn relatively simply off the two rotating bodies 1 and 2 in the direction of the axes of rotation thereof, assuming appropriate dimensioning of the bearing plate 18.1 and of a drive motor 26 shown in phantom in FIG. 3 which may be provided for the first rotating body 1.

By virtue of the guidance provided for the frame 15, the configuration according to FIG. 3 also makes possible a uniform tautening of the transmission element 3 over the width thereof, which proves to be advantageous, in particular, in the case of relatively wide transmission elements. A sufficiently great length of the eccentric shaft section 14.1 favors the ideal, parallel displacement of the first rotating body 1.

Figure 5:
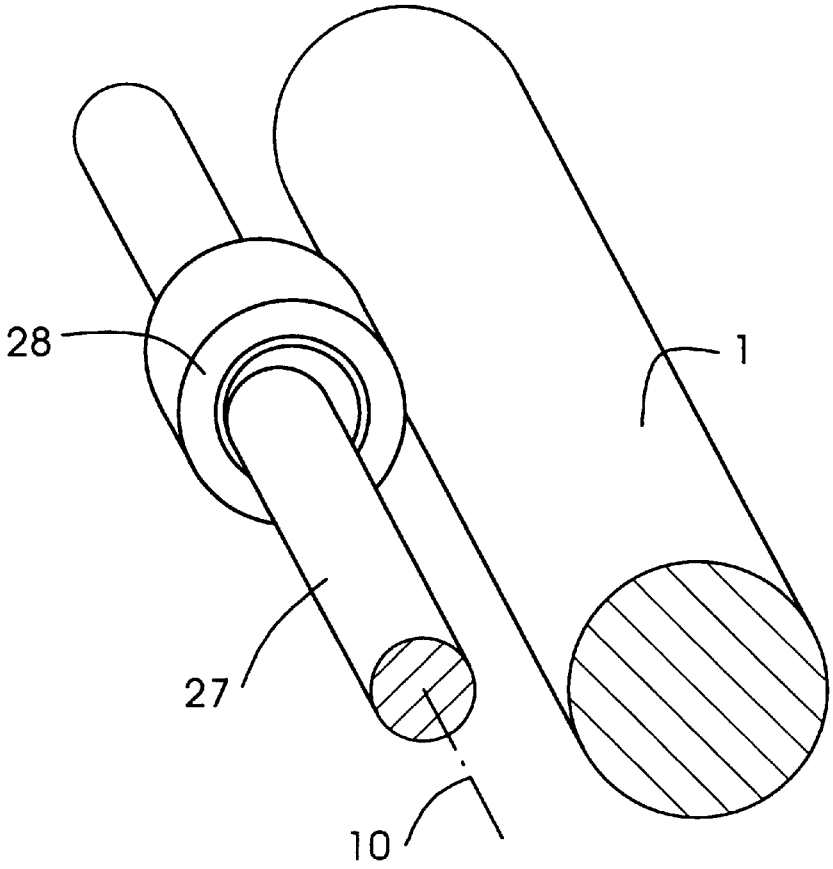
FIG. 5 is a fragmentary perspective view of the tensioning shaft showing a section thereof having an eccentric barrel ring which is rollable on a bearing or rolling surface of the first rotating body.

Whereas, in the aforedescribed configurations, the tensioning shaft 9 and 14, respectively, is in contact only with components which are stationary when operating, a configuration illustrated in FIG. 5 makes it possible to produce the operative connection between a tensioning shaft and the first rotating body 1 directly on the running surface of the latter. To this end, provision is once more made for a tensioning shaft 27 which has a center-of-mass line that is spaced from the longitudinal axis 10 thereof, and the tensioning shaft 27 carries at least one running ring 28 which is mounted eccentrically to the longitudinal axis 10 of the shaft 27.

A configuration of the device which is modified with respect to FIG. 1 is thus obtained, wherein the tensioning shaft 9 provided therein is replaced by the tensioning shaft 27, which is mounted in a manner corresponding to that of the tensioning shaft 9 and, by the force storing device 11, is subjected to a torque which causes the eccentrically mounted running ring 28 to press onto the running surface of the first rotating body 1.

In order to achieve an axially parallel displacement of the first rotating body 1, the eccentrically mounted running ring 28 may be constructed so as to extend adequately in the longitudinal direction of the tensioning shaft 27, and may be arranged centrally between the bearing plates 4.1 and 4.2. However, it is also possible for two eccentrically mounted running rings 28 to be provided and to be assigned to a respective end region of the running surface of the first rotating body 1.

Figure 6:
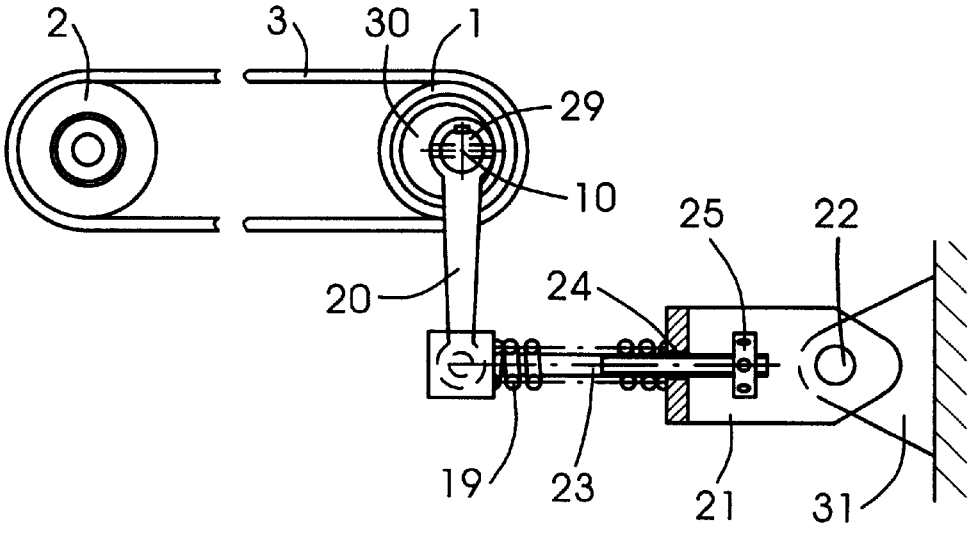
FIG. 6 is a view like that of FIG. 4 showing the tensioning shaft with an eccentric section for rotatably supporting the first rotating body.

According to a further configuration illustrated in FIG. 6, provision is made for a tensioning shaft 29 which has a section 30 rotatably supporting the first rotating body 1, is eccentric to the longitudinal axis 10 of the tensioning shaft 29 and thus likewise has a center-of-mass line which is spaced from the longitudinal axis 10. In the case of this configuration, too, the tensioning shaft 29 is, for its part, rotatable, as in the case of the configurations previously described, and is mounted in a fixed position with respect to the second rotating body 2. An ideal axially parallel displacement of the first rotating body 1 can in this case once more be achieved by an adequate extension of an individual eccentric section 30 and its central arrangement between bearings which accommodate a respective end of the tensioning shaft 30, or else by a construction or design of two eccentric sections 30 and an assignment thereof to a respective end section of the first rotating body 1.

In the exemplary embodiment according to FIG. 6, the actuating device, which is formed as a tensioning device, once more includes a force storing device 19 which acts upon the tensioning shaft 29, is formed as a helical spring which is stressed in compression and is otherwise supported in a manner similar to the exemplary embodiment according to FIG. 3 and FIG. 4. Accordingly, analogous components are provided with identical reference numerals or symbols in FIG. 6, on the one hand, and in FIGS. 3 and 4, on the other hand. The accommodation of the journal 22 in, for example, the bearing plate 4.2 according to FIG. 1, is symbolized in FIG. 6 by an eye 31. In the case of this configuration, the first rotating body 1 is once more formed as a diverting sleeve, in a manner similar to that according to FIG. 1.

If the transmission element 3 is already in the tensioned state when in a first position of the eccentric section 30 which virtually corresponds to the smallest axial spacing of the two rotating bodies 1 and 2, and if this state is achieved as a result of an increasing lengthening of the transmission element 3 during the operation of the transmission device and in a position of the eccentric section 30 which is rotated with respect to the aforementioned first position, then a respective side or strand of the transmission element 3 deviates from the alignment thereof which exists in the first position, more specifically, in the region where it runs onto or runs off the first rotating body 1, and by an amount which, in the most extreme case, corresponds to the eccentricity of the eccentric section 30. The transmission device which is disengaged in accordance with FIG. 6 can therefore be used, in particular, in cases wherein this positional deviation of the transmission element 3 is not accompanied by disadvantageous effects.

Figure 7:
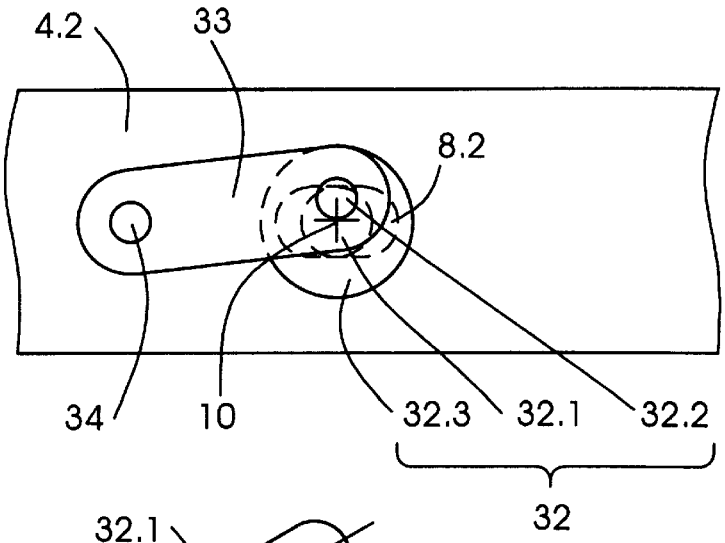
FIG. 7 is a basic representation of a tensioning shaft which is displaceable laterally by rotation thereof, has a shaft section rotatably supporting the first rotating body, and a crankpin eccentric to the shaft section and articulatedly connected to a crank pivotable with respect to a fixed pivot axis.

A further configuration of the transmission device results from the principle illustrated in FIG. 7. In regard thereto, provision is once more made for a tensioning shaft 32 having a center-of-mass line which is spaced apart from the longitudinal axis 10 thereof. This results from a construction or design of the tensioning shaft 32 according to which the latter has a shaft section 32.1 which rotatably supports the first rotating body 1, and at least one crankpin 32.2 which is eccentric to this shaft section 32.1. As can be seen from FIG. 7*a*, the shaft section 32.1 changes into a collar 32.3, which will is discussed hereinafter in greater detail at another location. For its part, the collar 32.2 finally changes into the eccentric crankpin 32.2. The tensioning shaft 32 is mounted so that it can be displaced laterally. This is indicated in FIG. 7 by a slot 8.2 which corresponds approximately to that of FIG. 1 and which is matched to the diameter of the shaft section 32.1, is formed in a bearing plate 4.2, approximately corresponding to FIG. 1, and accommodates the shaft section 32.1 displaceably with the effect of changing the axial spacing between the first rotating body 1 and the second rotating body 2 which is not illustrated in FIG. 7. The collar 32.3 rests on the outside of the bearing plate 4.2 via an end face thereof which faces the shaft section 32.1. The crankpin 32.2 is articulatedly connected to a crank 33 which, for its part, can be pivoted about a pivot axis 34 which is fixed with respect to the second rotating body 2. In the exemplary embodiment of FIG. 7, the pivot axis 34 is formed by a bolt which is fastened in the bearing plate 4.2.

The tensioning shaft 32 thus reacts to a rotation thereof with respect to the longitudinal axis thereof by way of a lateral yielding movement within the correspondingly dimensioned slot 8.2, within limits which are set by the eccentricity of the crankpin 32.2; that is to say, the first rotating body 1 which is mounted rotatably on the shaft section 32.1 experiences a lateral displacement while the axial spacing between the two rotating bodies 1 and 2 is changed, and an increase in this axial spacing results in a tautening of the transmission element 3.

Figure 7A:
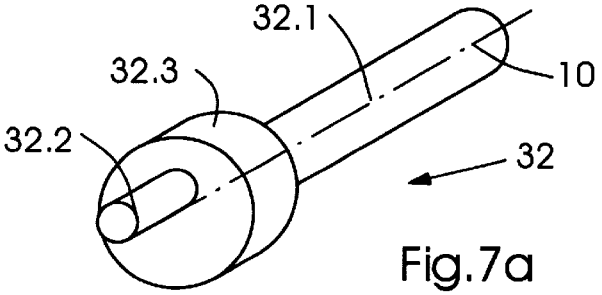
FIG. 7*a* is a perspective view of part of the tensioning shaft shown in FIG. 7.
Figure 8:
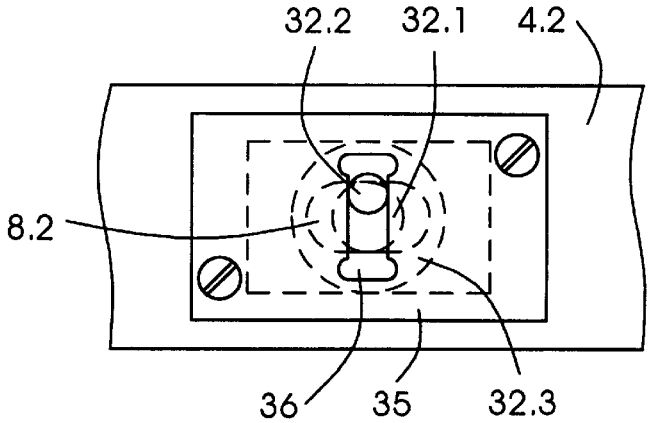
FIG. 8 is a basic representation of a tensioning shaft displaceable laterally by rotation thereof, and having a shaft section rotatably supporting the first rotating body, a crankpin eccentric to the shaft section, and a rectilinear guide supporting the crankpin.

The same result is achieved by the principle illustrated in FIG. 8. This likewise uses the tensioning shaft 32 according to FIG. 7*a*. However, as distinct from the configuration according to FIG. 7, the crankpin 32.2 is guided in a slotted guide 35, which forms a rectilinear guide supporting the crankpin 32.2, whereas, in the same manner as in the configuration according to FIG. 7, the shaft section 32.1 of the tensioning shaft 32 is guided in a slot 8.2 which is formed in the bearing plate 4.2 in such a manner that the first rotating body 1, which is not illustrated in FIG. 8, but is mounted in such a manner that it is rotatable by the shaft section 32.1, can be displaced laterally while the axial spacing between the two rotating bodies 1 and 2 is changed. This displacement once more results in a yielding movement of the tensioning shaft 32 when the latter is rotated with respect to the longitudinal axis 10 thereof, the yielding movement being caused by the fact that the crankpin 32.2 is supported on the rectilinear guide formed by the slotted guide 35; during the rotation of the tensioning shaft 32, the rectilinear guide guides the crankpin 32.2 perpendicularly to the longitudinal extent of the slot 8.2 and perpendicularly to a plane in which the longitudinal axis 10 of the tensioning shaft 32 and the axis of rotation of the second rotating body 2 (not illustrated here) are disposed. To this end, the slotted guide 35 has a slot 36 which is perpendicular to this plane and in which the crankpin 32.2 engages.

Figure 8A:
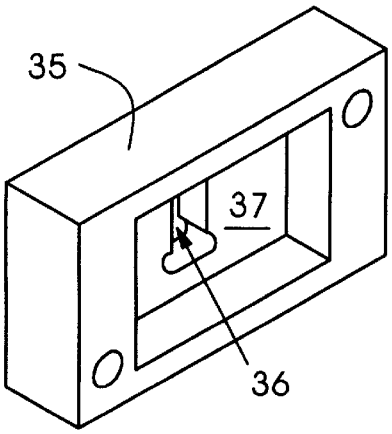
FIG. 8*a* is a slightly enlarged perspective view of FIG. 8, showing a slotted guide plate forming the rectilinear guide.

In the exemplary embodiment of FIG. 8, the slotted guide 35 is otherwise designed in the form of a slotted guide plate which is fastened to the outside of the bearing plate 4.2 and further has, on the side thereof facing the bearing plate 4.2, as shown in FIG. 8*a,* a cutout 37 into which the collar 32.3 that is provided on the tensioning shaft 32 passes in an unimpeded manner, even during the yielding movement of the tensioning shaft 32, whereas the slot 36 is machined into the slotted guide plate in the region of the cutout 37.

It is also conceivable to fasten to the bearing plate 4.2 a slotted guide plate which is provided with the slot 36, the fastening taking place at a distance from the outside of the bearing plate 4.2 which is matched to the thickness of the collar 32.3, with the result that the cutout 37 can be dispensed with.

Figure 9:
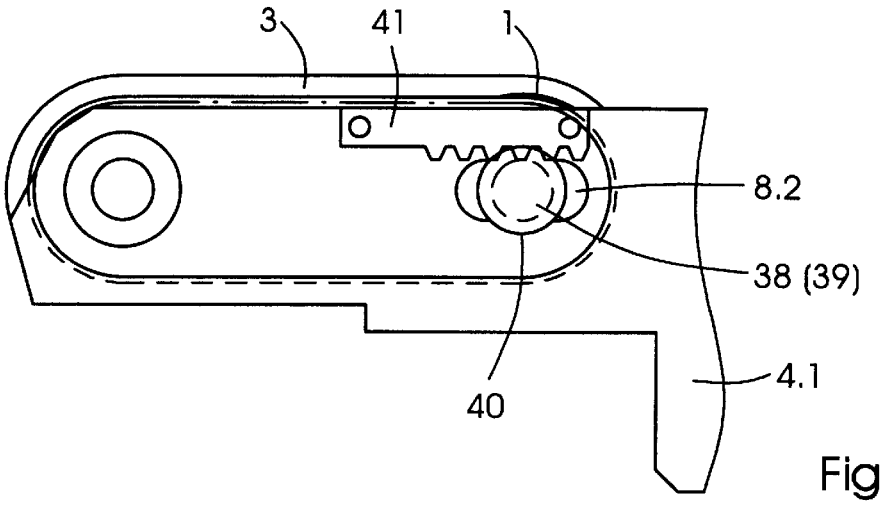
FIG. 9 is a simplified side elevational view of a transmission device according to the invention, having a tensioning shaft displaceable laterally by rotation thereof, rotatably supporting the first rotating body and connected to a gear wheel so as to be fixed against rotation relative thereto, the gear wheel being rollable on a rack when the tensioning shaft is rotated.

The pairing of the crankpin 32.2 and the slotted guide 35 can, in principle, be provided at both ends of the tensioning shaft 32, in particular, if the transmission device has a relatively broad transmission element 3. However, the construction or design of this pairing at only one end of the tensioning shaft 32 provides the possibility of free accessibility to the other end of the tensioning shaft 32, with the result that a torque can be introduced into the tensioning shaft 32 at this other end, in an advantageous manner, for example, by the force storing device 11 and 19, respectively, as noted hereinbefore. In particular, with free accessibility of the other end of the tensioning shaft 32, and an appropriate configuration of this end being provided, the torque can also be introduced by a tool. This is discussed hereinafter in greater detail in conjunction with further configurations of the transmission device which are illustrated in FIGS. 9 to 11.

The tensioning shafts 38 and 39, respectively, provided in the case of these configurations differ from the tensioning shaft 32 according to FIGS. 7, 7*a* and 8 to the extent that they have no eccentric crankpin, and the collar is constructed as a gear wheel 40. The tensioning shafts 38 and 39 of the configurations according to FIGS. 10 and 11, respectively, differ from one another in a detail which will be discussed more fully hereinbelow. Otherwise, they are equivalent to the configurations according to FIG. 10 and FIG. 11 which are reproduced in FIG. 9 in an elevational view.

The tensioning shaft 38 and 39, respectively, is mounted so that it can be displaced laterally in a slot 8.2 formed in a bearing plate 4.2 which is comparable with that according to FIG. 1, FIG. 7 and FIG. 8, respectively, analogous to the configurations according to FIG. 7 and FIG. 8, and has a shaft section 38.1 and 39.1, respectively, which rotatably supports a first rotating body 1, which is in turn constructed or designed here in the form of a deviating or deflecting sleeve. In the same way, as the collar 32.3 of the tensioning shaft 32 according to FIG. 7 and FIG. 8, respectively, the end face of the gear wheel 40, which faces the bearing plate 4.2, then rests on the outside of the bearing plate 4.2. The gear wheel 40 meshes with a rack 41 which is fastened to the outside of the bearing plate 4.2, so that when the tensioning shaft 38 or 39, respectively, is rotated, the gear wheel 40 rolls on the rack 41 with lateral displacement of the tensioning shaft 38 or 39, respectively, which is connected to the gear wheel so as to be fixed against rotation relative thereto. In this case, the lateral displacement of the tensioning shaft 38 or 39, respectively, inside the slot 8.2 guiding the latter, changes the axial spacing between the first rotating body 1 and the second rotating body 2, the latter being mounted in the bearing plate 4.2 and a bearing plate 4.1 located opposite the latter, with the result that a rotation of the tensioning shaft 38 or 39, respectively, with the effect of increasing this axial spacing, tautens the transmission element 3. Therewith, accordingly, an actuating device constituting a tensioning device for tautening the transmission element 3 is again provided, by which the first rotating body 1 can be displaced parallel to the axis of rotation thereof, the actuating device a tensioning shaft 38 or 39, respectively, which, when it is rotated about the longitudinal axis 10 thereof, displaces the center-of-mass line thereof laterally, the operative connection of the tensioning shaft 38 or 39, respectively, to the first rotating body 1 being produced by mounting the latter on the shaft section 38.1 or 39.1, respectively.

Figure 10:
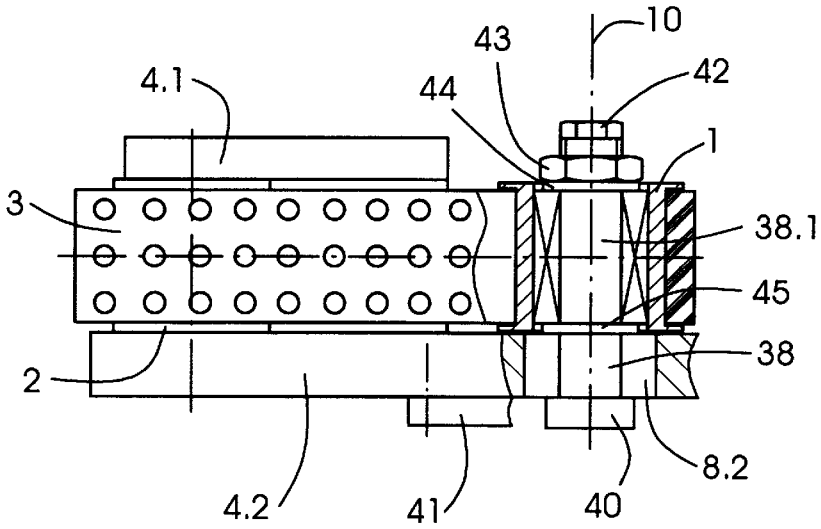
FIG. 10 is a plan view, partly broken away and partly in section, of another embodiment of the transmission device shown in FIG. 9, and showing a tensioning shaft which is fixable in a position assumed during the displacement of the center-of-mass line of the shaft.
Figure 11:
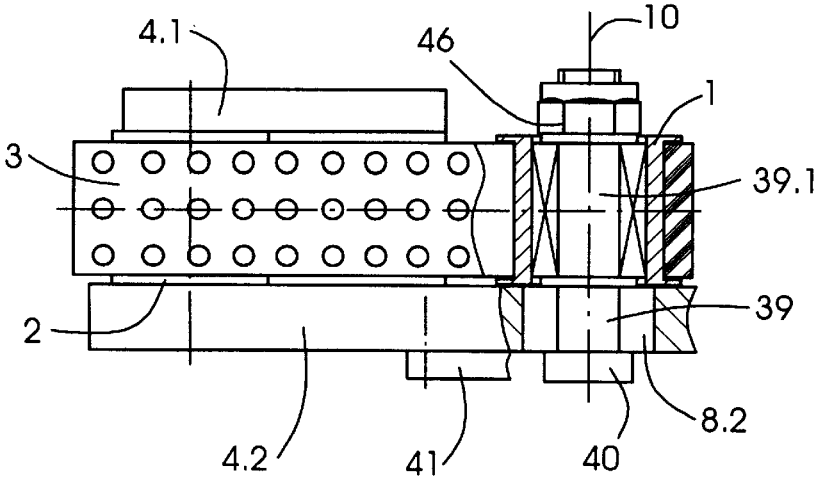
FIG. 11 is a view corresponding to that of FIG. 10 of a further embodiment of the transmission device according to FIG. 9, which differs from the embodiment of FIG. 10 with respect to the devices for initiating a rotational movement of the tensioning shaft and for fixing the tensioning shaft.

In contrast with the illustration in FIGS. 10 and 11, the bearing plate 4.1 and the tensioning shaft 38 or 39, respectively, can also be constructed or designed so that the latter is also guided in an appropriate slot in the bearing plate 4.1, and it is possible for a further gear wheel to be connected to the tensioning shaft 38 or 39, respectively, so as to be fixed against rotation relative thereto and to mesh with a further rack which is provided on the outside of the bearing plate 4.1. This further gear wheel then has to be arranged so that it is axially displaceable on the tensioning shaft 38 or 39, respectively.

The configurations according to FIGS. 10 and 11 which have only one gear wheel 40, and also the configuration having a further gear wheel have an advantage over the configurations according to FIGS. 7 and 8 in that, as mentioned further above, the introduction of a torque into the tensioning shaft 38 or 39, respectively, by a tool is possible, because of the direct accessibility of both ends of the tensioning shaft 38 or 39, respectively, at both ends of the latter.

In the illustrated exemplary embodiment according to FIG. 10, a hexagon head 42 is formed on that end of the tensioning shaft 38 that is located opposite the gear wheel 40, an appropriate wrench being able to be applied to the hexagon head in order thereby to rotate the tensioning shaft 38.

The torque necessary to rotate, in particular, the tensioning shaft 38 or 39, respectively, according to FIG. 10 or FIG. 11, respectively, can also be introduced by a force storing device acting upon the tensioning shaft 38 or 39, respectively, however. To this end, for example, in a manner similar to the configuration according to FIG. 3, FIG. 4 and FIG. 6, respectively, a spring stressed in compression may be used and, for example, a further rack, which is guided here so as to be longitudinally displaceable and mesh with the gear wheel 40, may be provided and acted upon in the longitudinal direction by the prostrating force of the spring.

Whereas, in the configurations having a force storing device which acts upon the tensioning shaft, the advantage of automatic re-tensioning of the transmission element 3 is achieved, the configurations according to FIGS. 7 to 11 prove to be advantageous, in particular, from the point of view of exchanging the transmission element 3. In the case of these configurations, the tensioning shaft 32 or 38 or 39, respectively, can be fixed in a position which is assumed while the center-of-mass line thereof is displaced. Corresponding precautions are illustrated by way of example in the case of the configurations according to FIGS. 10 and 11, and are taken here at that end of the tensioning shaft 38 or 39, respectively, which faces away from the gear wheel 40, although this would also be possible at the opposite end of the tensioning shaft 38 or 39, respectively. In the case of the configuration according to FIGS. 7 and 8, it would be necessary to take appropriate precautions, which are explained hereinbelow, on that end of the tensioning shaft 32 which faces away from the collar 32.3.

In the case of the configuration according to FIG. 10, the tensioning shaft 38 is provided, at the end thereof facing away from the gear wheel 40, with a thread which is additional to the previously mentioned hexagon head 42 and follows the latter, the thread having a nut 43 screwed thereon, by which the gear wheel 40 can be pressed against the outside of the bearing plate 4.2. When the nut 43 is tightened, this is supported in the exemplary embodiment of FIG. 10 via washers 44 and 45 which are pushed onto the tensioning shaft 38 and on inner rings of a bearing arrangement, located between these washers 44 and 45, for rotatably mounting the first rotating body 1 on the tensioning shaft 38.1 on the inner side of the bearing plate 4.2.

The tautening of the transmission element 3 is therefore performed by a lateral displacement of the tensioning shaft 38 while rotating the latter by a tool acting upon the hexagon head 42 with the effect of increasing the axial spacing of the two rotating bodies 1 and 2, and fixing the tensioning shaft 38 in the position assumed thereby by tightening the nut 43.

The configuration illustrated in FIG. 11 represents a development of the transmission device according to FIG. 10 in that, in this case, only the end of the tensioning shaft 39 which faces away from the gear wheel 40 is provided with a thread, onto which a nut 46 is likewise screwed. However, the screw connection that is produced in this way is constructed or designed so that it presents an increased braking torque counter to a screwing operation, such as is the case, for example, when self-securing nuts are used. In this case, the braking torque is selected so that any rotation of the nut 46 is transmitted to the tensioning shaft 39 until the lateral displacement of the latter under this rotation is opposed by a resistance which is no longer overcome by the braking torque. If, therefore, there is a rotation of the nut 46 with the effect of increasing the axial spacing of the two rotating bodies 1 and 2, this already results in a tautening of the transmission element 3. After a tautened state of the transmission element 3 has been achieved in this way, a further rotation of the nut 46 in the same direction of rotation has the effect of fixing the tensioning shaft 39 in the same manner as in the configuration according to FIG. 10. Both the tautening of the transmission element 3 and the fixing of the tensioning shaft 39 in the tautened state of the transmission element 3 are therefore performed in a single operation using one and the same tool by a simple rotation of the nut 46.

The illustration of a drive acting upon the second rotating body 2 has been dispensed with in FIGS. 9 to 11.

The configurations or embodiments according to these figures otherwise have the advantage, by comparison with those according to FIGS. 7 and 8, that it is possible to exert upon the transmission element a tensioning force that is independent of the rotational position of the tensioning shaft 38 or 39, respectively.

Figure 12:
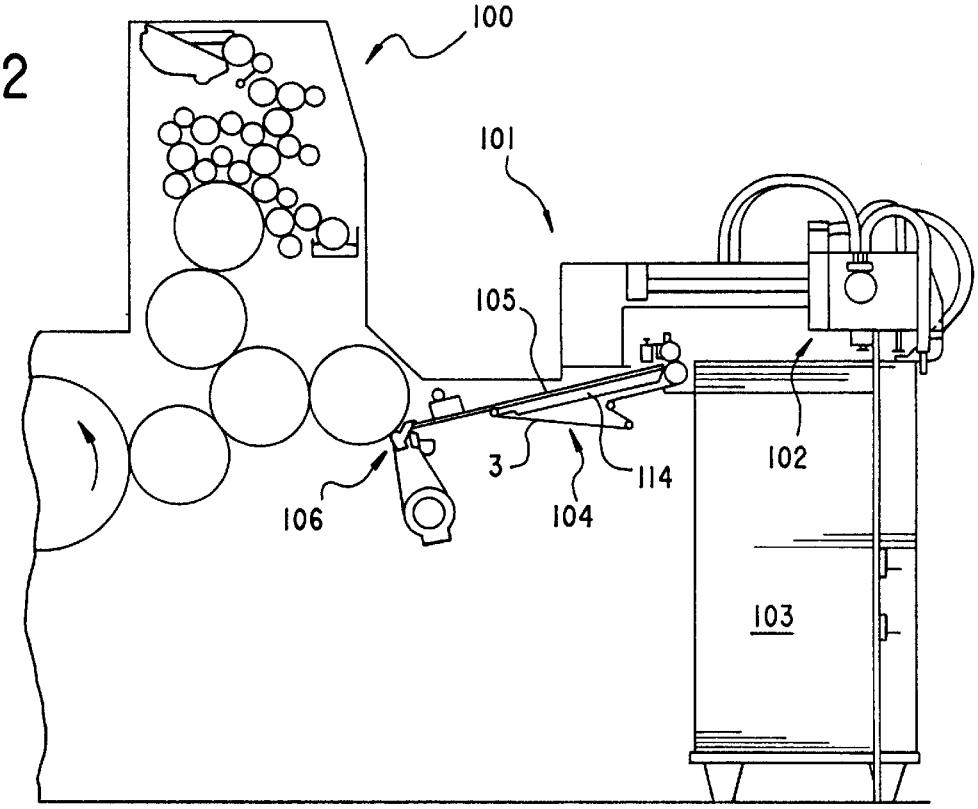
FIG. 12 is a diagrammatic side elevational view of a sheet transport device including the transmission device according to the invention, the sheet transport device being constructed in the form of a sheet feeder and cooperating with a printing unit of a sheet-fed printing machine.

A preferred use of the transmission device, insofar as it has been described, in a sheet transport device which cooperates with a printing unit of a sheet-fed printing machine is illustrated in FIG. 12. In this case, the sheet-fed printing machine is, by way of example, a rotary offset printing machine, of which a printing unit 100 and a sheet transport device 101 in the form of a feeder which feeds sheets to the printing unit 100 are reproduced diagrammatically. In operation, the feeder removes the sheets individually, with a separating or singling device 102, from a sheet pile 103 formed of the sheets and deposits the latter on a transport side or strand 105 of the transmission element 3 of the transmission device, which is identified in its entirety by reference numeral 104. The transmission device transports the separated sheets to a transfer device 106. In the exemplary embodiment at hand, the latter includes a pregripper which swings reciprocatingly in accordance with the sheet processing cycle between a feeder table and a feeder drum, seizes the sheets, which are aligned on the feeder table, at a gripper edge and transfers them to a gripper system provided on the feeder drum.

Figure 13:
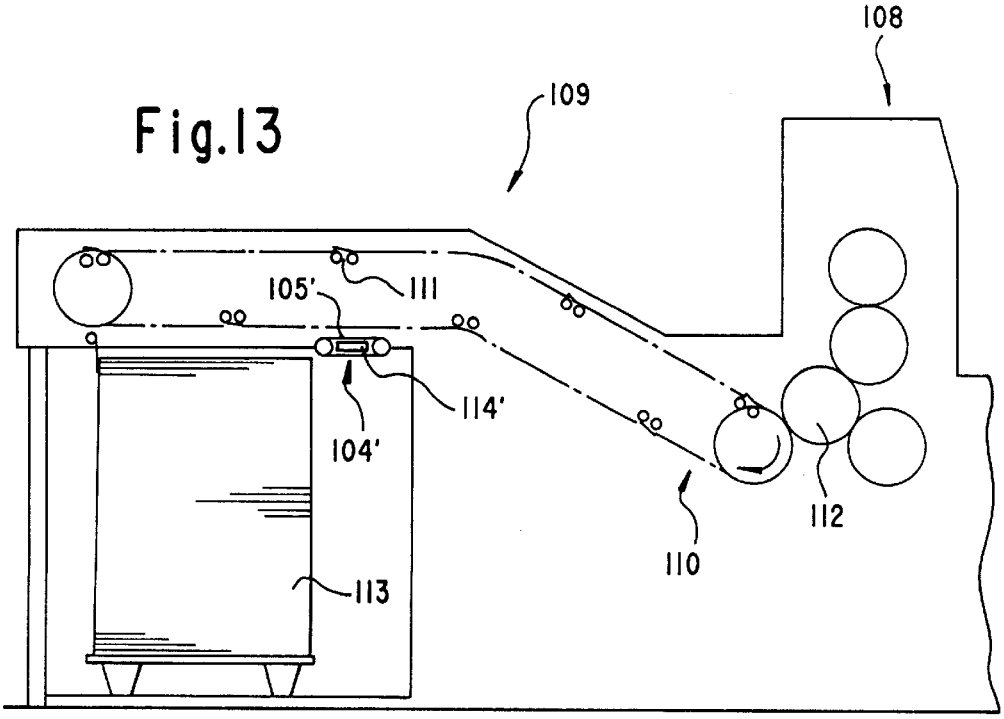
FIG. 13 is a diagrammatic side elevational view of a sheet transport device including the transmission device according to the invention, the sheet transport device being constructed in the form of a sheet delivery and cooperating with a printing unit of a sheet-fed printing machine.

A further preferred use of the transmission device is illustrated in FIG. 13. In this case, this likewise concerns the use of the transmission device 104' here, in a sheet transport device cooperating with a printing unit of a sheet-fed printing machine. By way of example, the parts of the sheet-fed printing machine reproduced diagrammatically are a printing unit 108, operating with the offset process, and the sheet transport device 109, cooperating with the latter, in the form of a sheet delivery which adjoins the printing unit 108. The delivery includes a sheet conveyor 110 in the form of a chain-conveyor loop having circulating gripper systems 111 which, when operating, take over sheets from the impression cylinder 112 of the printing unit 108 and, at machine speed, deposit them on a transport side or strand 105' of the transmission device 104, which is likewise illustrated only diagrammatically. In this case, the transmission device 104' is arranged, with respect to the transport direction of the sheets, upstream of a delivery pile 113, and after the sheets have been released by the gripper systems 111, it transports the sheets further at a selected speed profile of the transport side or strand 105'. The speed profile can be selected so that, in a first case, the sheets are retarded from machine speed to a depositing speed, at which they are then transferred to the delivery pile 113, whereas in a second case they are conveyed over the delivery pile 113 to a non-illustrated sample-sheet rest or depository.

In the applications of the transmission device 104, 104', insofar as they have been described, the inner side of its transport side or strand 105, 105' has a suction device 114, 114' assigned thereto, the suction effect of which acts through openings in the transmission element 3 and, hence, during operation, produces the retaining forces, which enable the transport of the sheets, between a respective sheet and the transport side or strand 105, 105' of the transmission element 3.

As is apparent from FIG. 13, with respect to the number of rotating bodies, there is no restriction to a first and a second rotating body.

I claim:

1. A transmission device for a printing machine, comprising:

an endless transmission element;

a longitudinal guide;

rotating bodies around which said transmission element is wrapped, a first one of said rotating bodies being rotatable mounted in said longitudinal guide;

a tensioning shaft being pivotable around a longitudinal axis, said tensioning shaft displacing said first one of said rotating bodies along said longitudinal guide and changing an axial spacing between said first one of said rotating bodies and a second one of said rotating bodies when said tensioning shaft is pivoted around it's longitudinal axis.

2. The transmission device according to claim 1, further comprising:

a crankpin disposed on said tensioning shaft and disposed eccentrically to the longitudinal axis of said tensioning shaft; and a crank having one end connected to said crankpin and another end pivotally connected about a pivot axis that is fixed with respect to said second one of said rotating bodies.

3. The transmission device according to claim 1, further comprising:

a crankpin disposed on said tensioning shaft and disposed eccentrically to the longitudinal axis of said tensioning shaft; and a linear guide supporting said crankpin.

4. The transmission device according to claim 1, further comprising:

a gear wheel connected to said tensioning shaft so as to be fixed against rotation relative thereto; and a rack whereon said gearwheel is rollable.

5. The transmission device according to claim 1, further comprising:

a frame including said longitudinal guide; and a screw connection for fixing a position of said tensioning shaft within said longitudinal guide.

6. The transmission device according to claim 1, including:

a screw connection opposing a screwing operation with a braking torque so that in a released condition of said screw connection, said tensioning shaft is rotatable around the longitudinal axis thereof by operating said screw connection.

7. A sheet-fed printing machine, comprising:

a printing unit;

a sheet transporting device supplying sheets to said printing unit, said sheet transporting device having a transmission device including:

an endless transmission element;

a longitudinal guide;

rotating bodies around which said transmission element is wrapped, a first one of said rotating bodies being rotatably mounted in said longitudinal guide;

a tensioning shaft being pivotable around a longitudinal axis, said tensioning shaft displacing said first one of said rotating bodies along said longitudinal guide and changing an axial spacing between said first one of said rotating bodies and a second one of said rotating bodies when said tensioning shaft is pivoted around it's longitudinal axis.

* * * * *